US009207552B2

(12) United States Patent
Matsushita et al.

(10) Patent No.: US 9,207,552 B2
(45) Date of Patent: Dec. 8, 2015

(54) CLASSIFYING APPARATUS, CLASSIFYING METHOD, TONER AND METHOD FOR PRODUCING THE TONER

(75) Inventors: Natsuko Matsushita, Shizuoka (JP); Tetsuya Tanaka, Shizuoka (JP); Nobuyasu Makino, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 548 days.

(21) Appl. No.: 13/209,828

(22) Filed: Aug. 15, 2011

(65) Prior Publication Data

US 2012/0048786 A1 Mar. 1, 2012

(30) Foreign Application Priority Data

Aug. 26, 2010 (JP) ..... 2010-189348

(51) Int. Cl.
*B04C 5/00* (2006.01)
*G03G 9/08* (2006.01)

(52) U.S. Cl.
CPC ..... *G03G 9/0817* (2013.01)

(58) Field of Classification Search
CPC ..... B07B 7/08; B07B 7/083; B07B 4/02; B07B 4/025; B07B 9/02; G03G 9/0817
USPC ..... 209/138, 139.1, 139.2, 143, 154, 710, 209/717, 718, 722
See application file for complete search history.

(56) References Cited

U.S. PATENT DOCUMENTS 3,015,392 A * 1/1962 Rozsa et al. ..... 209/134
4,221,655 A * 9/1980 Nakayama et al. ..... 209/135
5,016,823 A * 5/1991 Kato et al. ..... 241/5
2002/0021987 A1 2/2002 Tanaka et al.
2006/0214036 A1* 9/2006 Makino ..... 241/5

(Continued)

FOREIGN PATENT DOCUMENTS

CN 1109387 A 10/1995
CN 1031450 C 4/1996
CN 101357365 A 2/2009

(Continued)

OTHER PUBLICATIONS

Combined Office Action and Search Report issued Aug. 9, 2013 in Chinese Patent Application No. 201110243887.3 (with English translation).

(Continued)

*Primary Examiner* — Joseph C Rodriguez
*Assistant Examiner* — Kalyanavenkateshware Kumar
(74) *Attorney, Agent, or Firm* — Oblon, McClelland, Maier & Neustadt, L.L.P.

(57) ABSTRACT

A classifying apparatus including a cylindrical casing, a powder material feeding port, a louver ring disposed in the casing to be in communication with the powder material feeding port in a horizontal direction, a center core, a separator core, a dispersion chamber defined by the center core and an inner wall of the casing at the powder material-fed side, a classification chamber defined by the center core, the separator core and a side inner wall of the casing, and a flow path encircling the louver ring, wherein in a horizontal cross section of part of the classifying apparatus where the part contains the powder material feeding port and the louver ring, the louver ring is located at a position where the louver ring does not intersect with an extended line of a wall surface of the powder material feeding port at the side of the louver ring.

13 Claims, 9 Drawing Sheets

(56) References Cited

U.S. PATENT DOCUMENTS

| | | | |
|---|---|---|---|
| 2009/0032443 | A1 | 2/2009 | Taketomi et al. |
| 2009/0206008 | A1 | 8/2009 | Makino et al. |

FOREIGN PATENT DOCUMENTS

| | | | |
|---|---|---|---|
| DE | 2051533 | | 4/1972 |
| EP | 1 033 180 | A2 | 9/2000 |
| EP | 1 033 180 | A3 | 9/2000 |
| JP | 40-16232 | | 6/1940 |
| JP | 2-303559 | | 12/1990 |
| JP | 5-78392 | | 3/1993 |
| JP | 7-145207 | | 6/1995 |
| JP | 7-195037 | | 8/1995 |
| JP | 2597794 | | 1/1997 |
| JP | 10-43692 | | 2/1998 |
| JP | 2766790 | | 4/1998 |
| JP | 11-290785 | A | 10/1999 |
| JP | 2009-189980 | | 8/2009 |
| WO | WO 2007/145207 | A1 | 12/2007 |

OTHER PUBLICATIONS

Combined Chinese Office Action and Search Report issued Jan. 13, 2014 in Patent Application No. 201110243887.3 (with English language translation).

Office Action issued Mar. 18, 2014 in Japanese Patent Application No. 2010-189348.

Japanese Office Action dated Jul. 28, 2015 in corresponding Japanese patent application No. 2010-189348.

* cited by examiner

CLASSIFYING APPARATUS, CLASSIFYING METHOD, TONER AND METHOD FOR PRODUCING THE TONER

BACKGROUND OF THE INVENTION

1. Field of the Invention

The present invention relates to a classifying apparatus and a classifying method which are used to produce dry toner for developing electrostatic images in electrophotography, electrostatic recording, electrostatic printing, etc.; and to a toner and a method for producing the toner.

2. Description of the Related Art

Several traditional approaches are known for classifying pulverized coarse toner particles: a combination of a single classifier BZ1 and a single pulverizer FZ1 (as shown in FIG. 1, for example); a combination of two classifiers BZ1 and BZ2 and a single pulverizer FZ1 (as shown in FIG. 2, for example); and a combination of two classifiers BZ1 and BZ2 and two pulverizers FZ1 and FZ2 (as shown in FIG. 3, for example). Note that, in FIGS. 1 to 3, reference character A denotes a fine powder-classifying unit (step).

One type of the pulverizers used in these systems is a jet pulverizer that propels raw particles in a high-pressure air stream spouted from a jet nozzle to cause the particles to collide with each other or hit a wall or other objects and thus pulverize the particles.

The jet pulverizer will be described with reference to FIG. 3.

In FIG. 3, raw materials are fed through a feed pipe FE1, and together with the previously pulverized product and high-pressure air, introduced into a first classifier BZ1 where they are classified into coarse powder and fine powder.

The coarse powder is pulverized in a first pulverizer FZ1 and collected once in a cyclone CY1. The collected powder is introduced into a second classifier BZ2 where it is classified again into coarse powder and fine powder.

The thus-classified coarse powder is then pulverized in a second pulverizer FZ2 and collected in a cyclone CY2.

The collected powder is sent to a fine powder-classifying unit where it is classified into fine powder and a final product.

In this jet pulverizer, however, the powder fed to the first pulverizer BZ1 contains not only the raw powder but also particles of various sizes that are in the process of pulverization. Thus, the jet pulverizer is low in classification efficiency, which is problematic.

FIG. 4 shows the configuration of an air classifying apparatus (a DS air classifying apparatus) that is used as the pulverizer BZ1 or BZ2.

The air classifying apparatus includes a dispersion chamber (or collector dispersion chamber) 1, a classification chamber 7 and a bottom hopper 8.

A powder material feeding port 2 for feeding a primary air stream and powder material is connected with the dispersion chamber 1 at the upper periphery as a flow inlet at the circumferential surface of a cylindrical casing 15.

An umbrella-shaped center core 9 is disposed within the dispersion chamber 1 near its bottom. Further, an umbrella-shaped separator core 13 is disposed below the center core 9. A slatted secondary air stream inlet 14 (also referred to as "louver") is disposed about the classification chamber 7 along the outer periphery thereof to facilitate dispersion of the powder materials and accelerate the swirling of the powder materials.

In this manner, the fine powder within the classification chamber 7 is guided to a fine powder discharge port 10 provided in the separator core 13 and discharged through a fine powder discharge pipe 11 connected to the fine powder discharge port 10 by the suction force provided by a blower.

On the other hand, the coarse powder is discharged from an annular coarse powder discharge port 12 provided along the outer periphery of the lower edge of the separator core 13.

A typical DS air classifier operates by the principle that centrifugal and centripetal forces of different magnitudes act on the coarse particles and fine particles present in a powder material as the secondary air stream flows into the classification chamber and causes a non-free flow of the swirling particles.

For this reason, it is desirable that the particles dispersed in the classification chamber be quickly classified into coarse particles and fine particles without allowing the particles to re-aggregate together.

However, conventional DS air classifying apparatuses are now required to disperse an increased number of particles because toner particles are becoming increasingly small and pulverization performance of pulverizers has improved significantly. When used to disperse such increased number of particles, the dispersion performance of conventional DS air classifying apparatuses will decrease, resulting in decreased classification accuracy. This inevitably leads to inclusion of coarse particles into a fine powder discharge region. As a result, the product obtained by the classification process may cause background smear and improper transfer and may therefore lead to decreased image quality.

Also, such inclusion of coarse particles may also impose an excessive load on the classifier during the production process and may thus decrease the efficiency of classification as well as the energy efficiency of pulverization.

Japanese Patent (JP-B) No. 2766790 or other documents disclose a classifier in which a louver is provided in a dispersion chamber (collector).

In this classifier, a nozzle is inserted in the louver for introducing powder and primary air. Secondary air is introduced from the outer periphery of the louver to facilitate the dispersion of the powder. This configuration is disadvantageous in that when raw materials are fed with high-pressure air, the pressure difference within the dispersion chamber causes the raw materials to be released from the dispersion chamber into the atmosphere, making it difficult to further continue to conduct the classification process.

Also, Japanese Patent Application Laid-Open (JP-A) No. 2009-189980 discloses an air classifier including a louver ring having a plurality of guide slats annularly arranged at regular intervals in a dispersion chamber, and a flow path which encircles the louver ring and receives high-pressure air and powder material fed from a powder material feeding port, wherein ultrafine powder generated through pulverization is collected in advance in the dispersion chamber to increase classification accuracy and wherein the high-pressure air and raw material are passed through the gaps between the slats of the louver ring disposed inside the dispersion chamber to a collector dispersion chamber thereby improving dispersibility. Use of this air classifier allows the powder material fed from the powder material feeding port to pass through the gaps between the slats of the louver ring, whereby it can be fed to the dispersion chamber from the entire circumferential positions. The above air classifier shows an advantageous effect of preventing aggregation of the particles as compared with conventional classifiers.

However, since part of the louver ring is located across an extended line of the louver ring side wall (i.e., an extended line of a straight line connecting a powder material feeding port's inner inlet and a powder material feeding port's inner outlet) (FIG. 5), in the above classifier, air flow fed from the powder material feeding port collide with the slats to potentially be slow in swirling speed. In addition, as a result of the collision of the airflow with the slats, the airflow through the gaps between the slats is disturbed, and the speed of the airflow through the gaps therebetween is varied from place to place in the annually arranged slats. Thus, the fed powder material is not sufficiently dispersed to potentially lead to a drop in classification accuracy and production yield, which is problematic.

Also, JP-B No. 2597794 or other documents disclose a technique in which after charged through a raw material feeding pipe, raw material (toner) is dispersed by gas introduced from a guide vane of a dispersion chamber.

However, this proposed technique poses a problem that the fed raw material cannot efficiently be dispersed since both of the raw material and the gas do not pass through the louver ring.

BRIEF SUMMARY OF THE INVENTION

The present invention aims to provide a classifying apparatus and a classifying method which can separate with high efficiency particles of desired particle size by improving classification accuracy in a classification chamber of the classifying apparatus; and a toner and a method for producing the toner.

Means for Solving the Existing Problems are as Follows

<1> A classifying apparatus including:

a cylindrical casing, a powder material feeding port for feeding high-pressure air and powder material to the cylindrical casing, a louver ring disposed in the casing so as to be in communication with the powder material feeding port in a horizontal direction, the louver ring having a plurality of arc-shaped guide slats annularly arranged, a center core disposed at the powder material-discharged side of the powder material feeding port, a separator core disposed at the powder material-discharged side of the center core, the separator core having an opening at a center thereof, a dispersion chamber defined by the center core and an inner wall of the casing at the powder material-fed side, the dispersion chamber being for dispersing the powder material together with the high-pressure air, a classification chamber defined by the center core, the separator core and a side inner wall of the casing, the classification chamber being for centrifugally separating the powder material fed from the dispersion chamber into fine powder and coarse powder, and a flow path encircling the louver ring, the flow path receiving the high-pressure air and the powder material fed from the powder material feeding port, wherein in a horizontal cross section of part of the classifying apparatus where the part contains the powder material feeding port and the louver ring, the louver ring is located at a position where the louver ring does not intersect with an extended line of a wall surface of the powder material feeding port at the side of the louver ring.

<2> The classifying apparatus according to <1>, wherein the classifying apparatus satisfies a relationship of $R1 \geq R2$ where, in the horizontal cross section, R1 denotes a distance from the center of the louver ring to an intersection point which is formed by the extended line of the wall surface of the powder material feeding port at the side of the louver ring and by a line that extends from the center of the louver ring in parallel with a line containing a feed opening of the powder material feeding port; and R2 denotes a distance from an outer circumference of the louver ring to the center of the louver ring.

<3> The classifying apparatus according to <1> or <2>, wherein the classifying apparatus satisfies a relationship of $\alpha \geq 30°$ where, in the horizontal cross section, a denotes an angle formed between lines connecting the center of the louver ring with both ends of each of the guide slats.

<4> The classifying apparatus according to any one of <1> to <3>, wherein the classifying apparatus satisfies a relationship of $\beta \geq 15°$ where, in the horizontal cross section, β denotes an angle formed between two lines one of which connects the center of the louver ring with an intersection point formed by the extended line of the wall surface of the powder material feeding port at the side of the louver ring and by the line that extends from the center of the louver ring in parallel with the line containing the feed opening of the powder material feeding port, and the other of which connects the center of the louver ring with an intersection point formed by the side inner wall of the casing and the wall surface of the powder material feeding port at the side of the louver ring.

<5> The classifying apparatus according to any one of <1> to <4>, wherein the guide slats are arranged at regular intervals concentrically around a central axis of the classifying apparatus in the gravity direction.

<6> The classifying apparatus according to any one of <1> to <5>, wherein the guide slats are detachably mounted.

<7> A classifying method including:

performing classification with the classifying apparatus according to any one of <1> to <6>.

<8> A method for producing a toner, including:

classifying powder material with the classifying apparatus according to any one of <1> to <6>.

<9> A toner obtained by the method for producing a toner according to <8>.

The present invention can provide a classifying apparatus and a classifying method which can separate with high efficiency particles of desired particle size by improving classification accuracy in a classification chamber of the classifying apparatus; and a toner and a method for producing the toner. These can solve the existing problems.

DETAILED DESCRIPTION OF THE INVENTION

Classifying Apparatus and Classifying Method

A classifying apparatus will next be described. Through the description of the classifying apparatus, a classifying method of the present invention will also be described in detail.

The classifying apparatus of the present invention includes at least a casing, a powder material feeding port, a louver ring, a center core and a separator core; and, if necessary, further includes other members.

The classifying apparatus includes a dispersion chamber, a classification chamber and a flow path.

Figure 6:
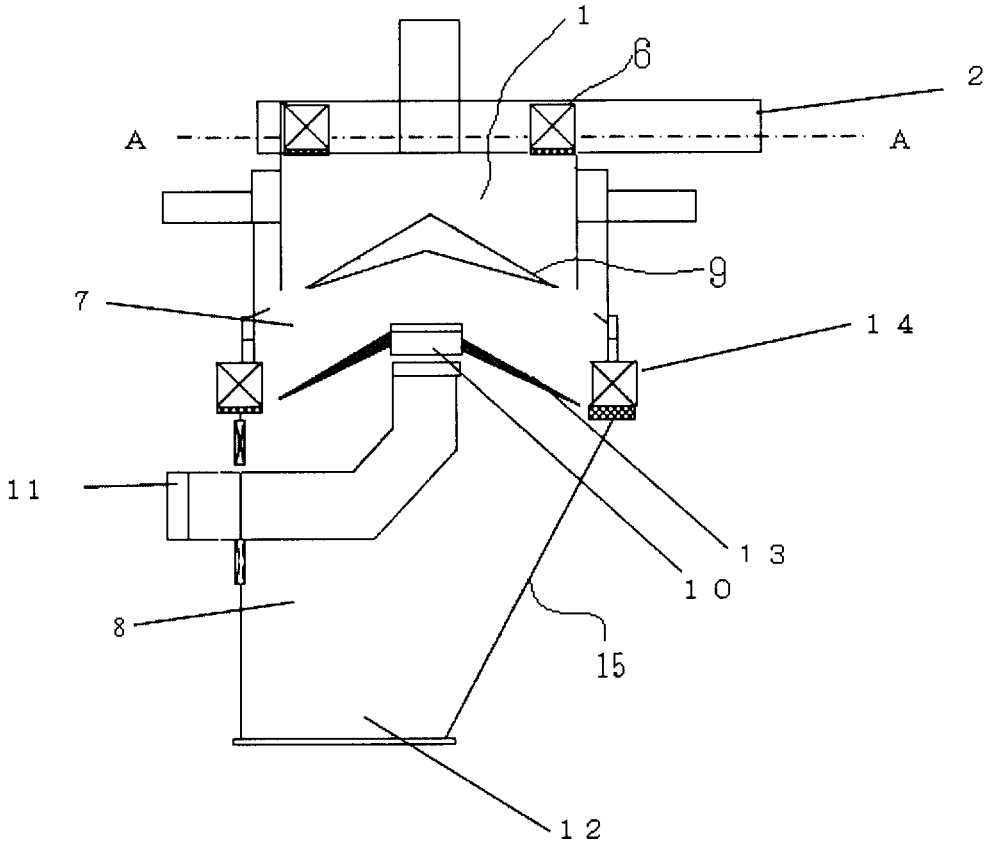
FIG. 6 is a schematic view of the configuration of a classifying apparatus of the present invention.
Figure 7:
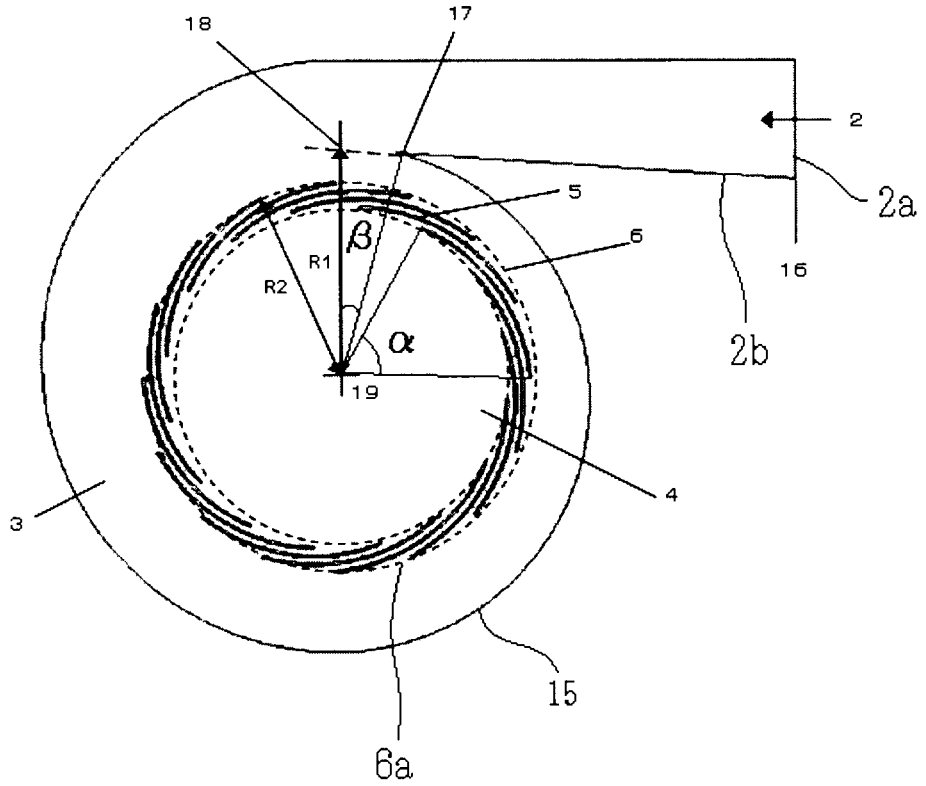
FIG. 7 is a cross-sectional view of FIG. 6, which is taken by line A-A.
Figure 8A:
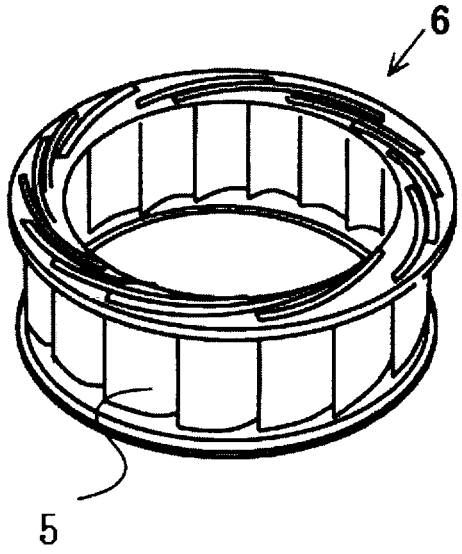
FIG. 8A is a schematic view of the configuration of a louver ring (part 1).
Figure 8B:
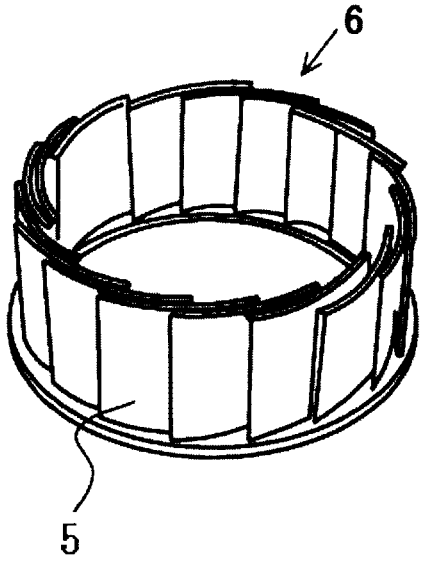
FIG. 8B is a schematic view of the configuration of a louver ring (part 2).
Figure 8C:
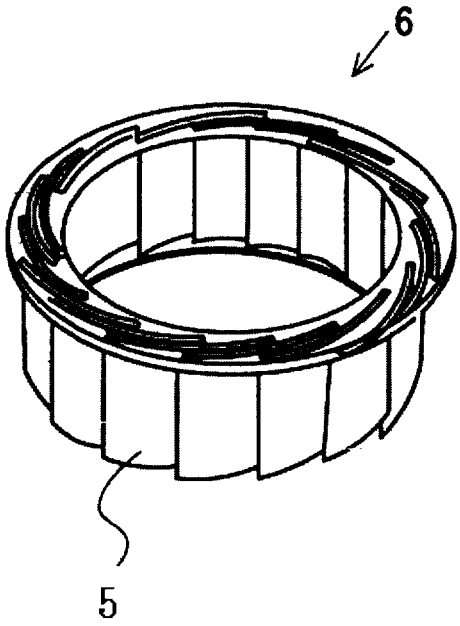
FIG. 8C is a schematic view of the configuration of a louver ring (part 3).
Figure 8D:
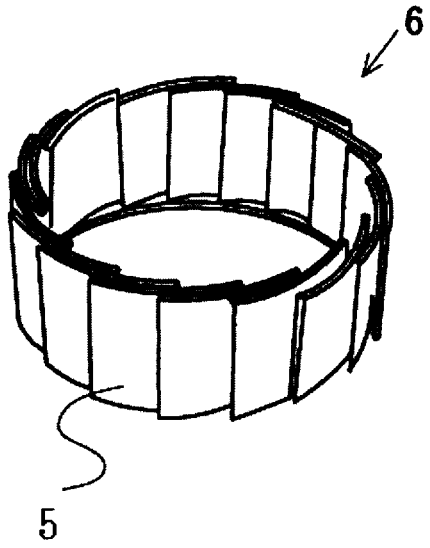
FIG. 8D is a schematic view of the configuration of a louver ring (part 4).

As used herein, "horizontal cross section" refers to a cross section perpendicular to the gravity direction of the classifying apparatus and is, for example, FIG. 7 which is a cross-sectional view of FIG. 6 taken by line A-A.

<Casing>

The shape of the casing is not particularly limited, so long as the casing has a cylindrical shape, and may be appropriately selected depending on the intended purpose.

The structure, size and material of the casing are not particularly limited and may be appropriately selected depending on the intended purpose.

<Powder Material Feeding Port>

The powder material feeding port is disposed at an upper part of the casing and is for feeding high-pressure air and powder material to the casing. The powder material feeding port is defined by the inner wall of the powder material feeding port and a feed opening from which the high-pressure air and powder material are fed.

The shape, structure, size and material of the powder material feeding port are not particularly limited and may be appropriately selected depending on the intended purpose.

The shape of the feed opening is not particularly limited and may be appropriately selected depending on the intended purpose. The feed opening is, for example, circular or rectangular.

When the feed opening is circular, the diameter of the feed opening is not particularly limited and may be appropriately selected depending on the intended purpose. It is preferably 110 mm to 170 mm.

—High-Pressure Air—

The high-pressure air is not particularly limited and may be appropriately selected depending on the intended purpose. Examples of the high-pressure air include air with a pressure of 0.4 MPa to 0.7 MPa.

—Powder Material—

The powder material is not particularly limited and may be appropriately selected depending on the intended purpose. Examples thereof include resin and metal powder.

The volume average particle diameter of the powder material is not particularly limited and may be appropriately selected depending on the intended purpose. It is preferably 3 μm to 15 μm, more preferably 5 μm to 8 μm.

<Louver Ring>

The louver ring has a plurality of guide slats annularly arranged and is disposed at an upper part of the casing so as to be in communication with the powder material feeding port in a horizontal direction.

The louver ring is disposed at a position where the louver ring does not intersect with an extended line of a wall surface of the powder material feeding port at the side of the louver ring.

—Guide Slat—

The cross-sectional shape of the guide slat is not particularly limited and may be appropriately selected depending on the intended purpose. The cross-sectional shape of the guide slat is, for example, an arc shape or a rectangular shape.

In particular, the cross-sectional shape of the guide slat is preferably an arc shape in order for air or particles to smoothly flow through the gap between the guide slats.

The guide slats are preferably arranged at regular intervals concentrically around the central axis of the classifying apparatus in the gravity direction, since a uniform centrifugal force can be applied to powder charged from the powder material feeding port.

The thickness of the guide slat is not particularly limited and may be appropriately selected depending on the intended purpose. It is preferably 2 mm to 6 mm.

When the thickness of the guide slat is smaller than 2 mm, a louver ring formed therefrom decreases in mechanical intensity. In addition, depending on the composition of a powder material, the guide slats may be broken during continuous operation as a result of abrasion of the surfaces of the guide slats. When the thickness of the guide slat is greater than 6 mm, the gap between the guide slats becomes small, so that the fed air does not smoothly flow due to pressure loss. As a result, the speed of the air or particles flowing decreases in the classification chamber, potentially degrading classification efficiency.

Preferably, the guide slats are detachably mounted. This is because only the guide slats can be replaced to reduce the cleaning time; i.e., it is not necessary to change the casing.

The angle $\alpha$ formed between lines connecting the center of the louver ring with both ends of the guide slat (FIG. 7) is not particularly limited and may be appropriately selected depending on the intended purpose. The angle $\alpha$ is preferably 30° or greater, more preferably 30° to 60°, particularly preferably 40° to 60°.

When the angle $\alpha$ is smaller than 30°, the speed of powder flowing through the gap does not increase, resulting in that the circumferential speed may be varied. Whereas when the angle $\alpha$ is in the range of 40° to 60°, the speed of powder flowing through the gap increases to stabilize the circumferential speed, which is advantageous.

The number of the guide slats used is not particularly limited and may be appropriately selected depending on the intended purpose. It is preferably 10 to 20, more preferably 12 to 16.

The gap size between the guide slats is not particularly limited and may be appropriately selected depending on the intended purpose.

<Center Core>

The center core is disposed below the powder material feeding port; i.e., at the side where the powder material is discharged (at the powder material-discharged side).

The shape of the center core is not particularly limited and may be appropriately selected depending on the intended purpose. The center core preferably has an umbrella shape since swirling flow can be generated smoothly.

The structure, size and material of the center core are not particularly limited and may be appropriately selected depending on the intended purpose.

The center core has a fine powder discharge port provided at the center thereof and a fine powder discharge pipe extending toward an opening of the below-described separator core.

With this configuration, the pulverized product or raw materials fed together with high-pressure air can further be dispersed in the below-described dispersion chamber as compared with the case of the conventional classifying apparatus. The ultrafine powder generated through pulverization can be collected in advance in the dispersion chamber to increase classification accuracy. Also, it is possible to prevent excessive pulverization and reduce the amount of the coarse powder contaminating the fine powder (finished product).

In the present invention, "the center of the louver ring" has the same meaning as "the center of the center core" and "the center of the casing."

<Separator Core>

The separator core has an opening at the center thereof and is disposed below the center core; i.e., at the powder material-discharged side.

The shape of the separator core is not particularly limited and may be appropriately selected depending on the intended purpose. Similar to the center core, the separator core preferably has an umbrella shape since swirling flow can be generated smoothly.

The structure, size and material of the separator core are not particularly limited and may be appropriately selected depending on the intended purpose.

The separator core has a fine powder discharge port (denoted by reference numeral 10 in FIG. 6) at the center thereof and a fine powder discharge pipe extending from the opening of the separator core (denoted by reference numeral 11 in FIG. 6). With this configuration, it is possible to improve classification accuracy to prevent excessive pulverization and reduce the amount of the coarse powder contaminating the fine powder (finished product).

<Dispersion Chamber>

The dispersion chamber is defined by the center core and the upper inner wall of the casing; i.e., the inner wall of the casing at the side where the powder material is fed (the inner wall of the casing at the powder material-fed side), and is for dispering a powder material together with the high-pressure air.

The shape, structure and size of the dispersion chamber are not particularly limited and may be appropriately selected depending on the intended purpose.

<Classification Chamber>

The classification chamber is defined by the center core, the separator core and the inner wall of the casing and is for centrifugally separating, into fine powder and coarse powder, the powder material fed from the dispersion chamber.

The shape, structure and size of the classification chamber are not particularly limited and may be appropriately selected depending on the intended purpose.

<Flow Path>

The flow path encircles the outer circumference of the louver ring and is for receiving the high-pressure air and the powder material fed from the powder material feeding port.

<Relationship Between Distance R1 and Distance R2>

As shown in FIG. 7, the relationship R1≥R2 is satisfied, where R1 denotes a distance from the center 19 of the louver ring 6 to an intersection point 18 which is formed by an extended line of a wall surface 2*b* of the powder material feeding port 2 at the side of the louver ring and by a line that is in parallel with a line containing the feed opening 2*a* of the powder material feeding port 2 and that passes through the center 19 of the louver ring 6 (i.e., a distance from the center 19 of the louver ring 6 to an intersection point 18 which is formed by an extended line of a straight line 2*b* connecting the inner portion at the inlet (inner inlet 16) with the inner portion at the outlet (inner outlet 17) of the powder material feeding port 2 and by a straight line that extends from the center 19 of the louver ring 6 in parallel with the powder material feeding port) and R2 denotes a distance from the outer circumference 6*a* of the louver ring to the center 19 of the louver ring 6.

<Angle β>

As shown in FIG. 7, angle β is not particularly limited and may be appropriately selected depending on the intended purpose. It is preferably 15° or greater, more preferably 30° or greater. Here, the angle β denotes an angle formed between a line connecting an intersection point 18 with the center 19 of the louver ring 6 and a line connecting an intersection point 17 with the center 19 of the louver ring 6, where the intersection point 18 is formed by an extended line of a wall surface 2*b* of the powder material feeding port 2 at the side of the louver ring (i.e., an extended line of a straight line 2*b* connecting the inner inlet 16 with the inner outlet 17 of the powder material feeding port 2) and by a line that is in parallel with a line containing the feed opening 2*a* of the powder material feeding port 2 and that passes through the center 19 of the louver ring 6; and the intersection point 17 is formed by the inner wall of the casing 15 and the wall surface 2*b* of the powder material feeding port 2 at the side of the louver ring (i.e., the inner outlet of the powder material feeding port 2).

When the angle β is smaller than 15°, the speed of air flow circulating inside the casing becomes high, it may be difficult for toner particles to pass through the gaps of the louver ring to lead to the classification chamber. Whereas when the angle β is 30° or greater, the speed of air flow circulating inside the casing becomes low, it is easy for toner particles to pass through the gaps of the louver ring to lead to the classification chamber, which is preferred.

Next will be described an air classifying apparatus according to the present invention.

Figure 1:
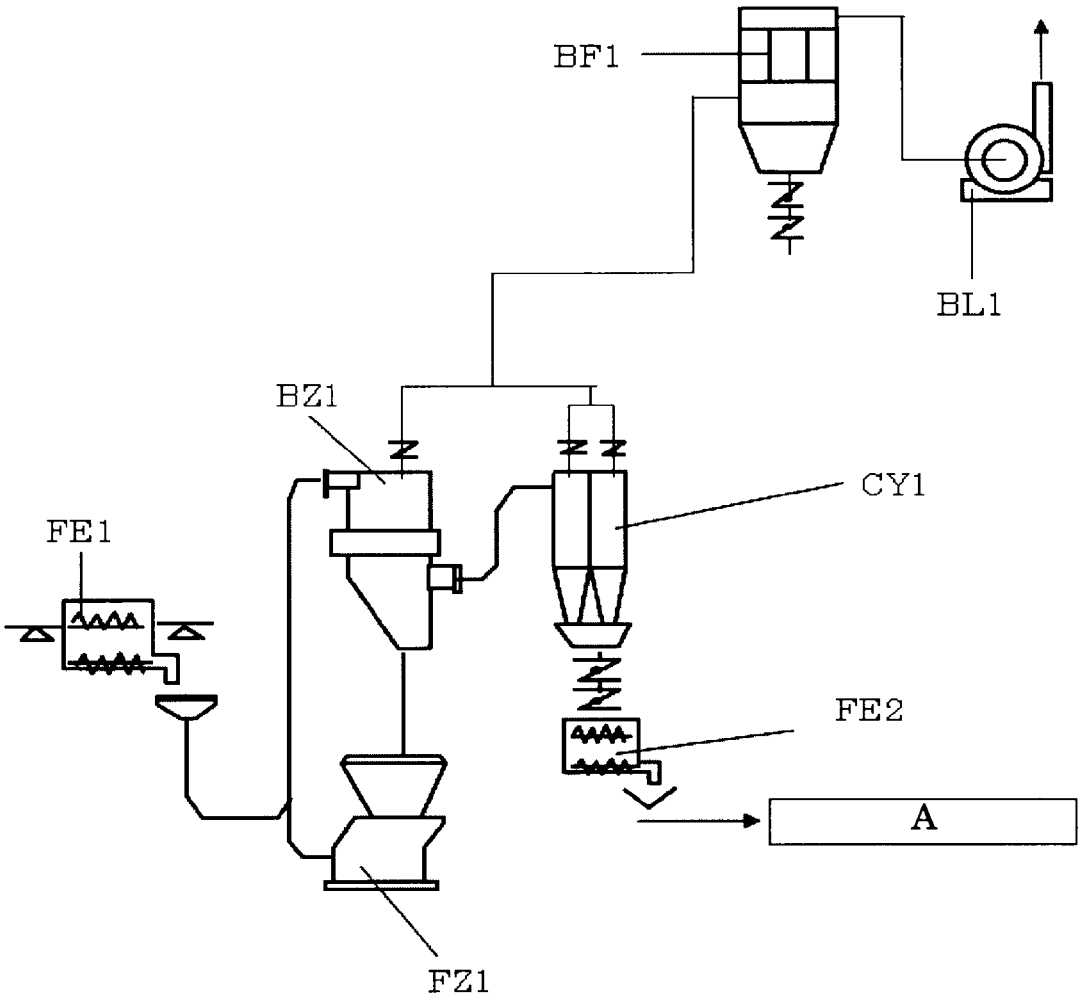
FIG. 1 is a system diagram showing the flow of classification of coarsely pulverized toner powder (part 1).
Figure 2:
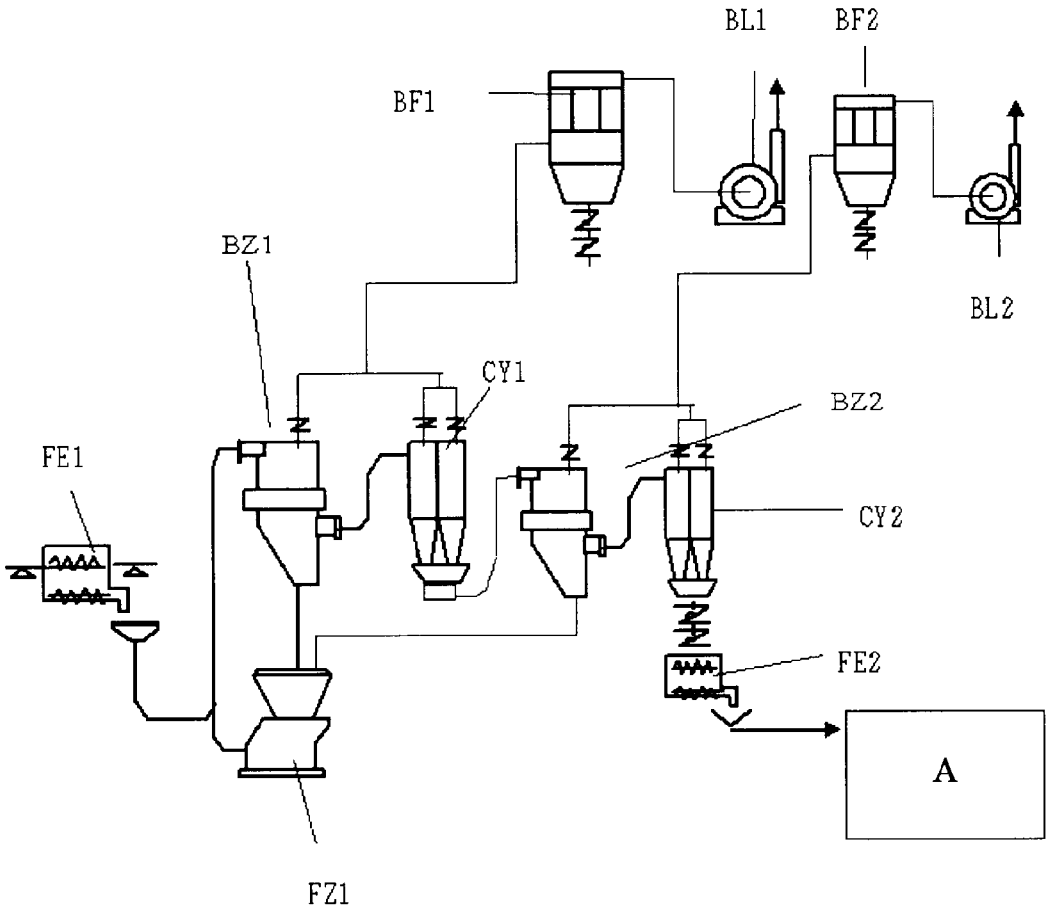
FIG. 2 is a system diagram showing the flow of classification of coarsely pulverized toner powder (part 2).
Figure 3:
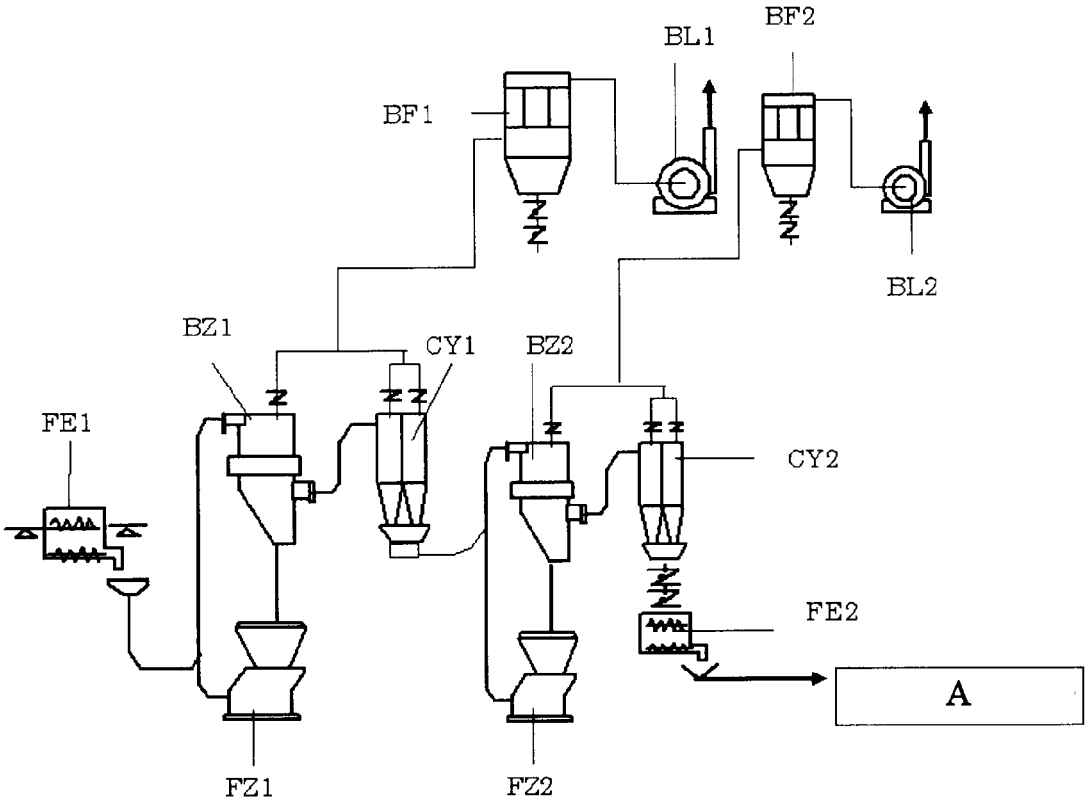
FIG. 3 is a system diagram showing the flow of classification of coarsely pulverized toner powder (part 3).
Figure 4:
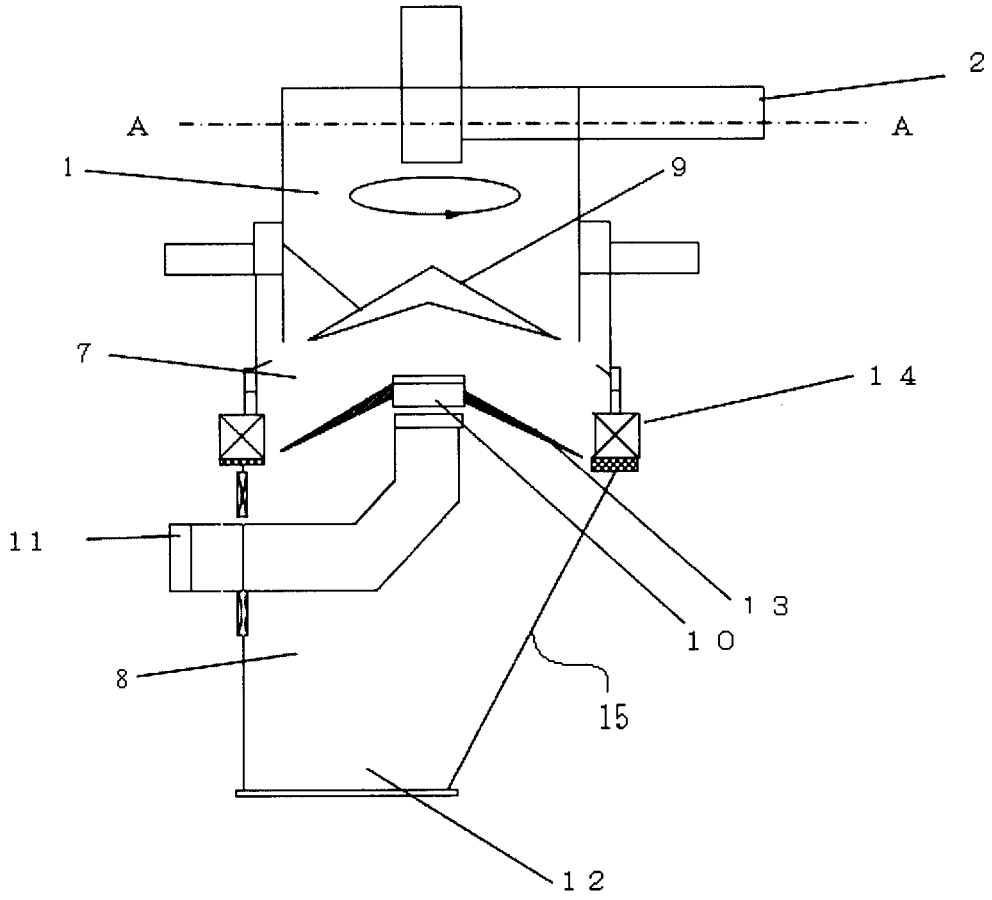
FIG. 4 is a schematic cross-sectional view of the configuration of a conventional classifying apparatus.

Notably, the air classifying apparatus of the present invention is used at the pulverized coarse particle classifying step shown in FIGS. 1 to 3.

FIG. 6 is a schematic cross-sectional view of an air classifying apparatus of the present invention.

The air classifying apparatus illustrated in FIG. 6 contains a cylindrical casing 15 provided with a powder material feeding port 2 configured to feed high-pressure air and a powder material (powdery raw materials and pulverized products of the raw materials) to an upper part of the casing; and, from top to bottom in the casing, an umbrella-shaped center core 9; an umbrella-shaped separator core 13 having an opening 10 at the center thereof; a dispersion chamber 1 for dispersing the powder material fed together with the high-pressure air where the dispersion chamber is defined by the upper inner wall of the casing 15 and the center core 9; a classification chamber 7 for centrifugally separating the powder material fed from the dispersion chamber 1 into fine powder and coarse powder where the classification chamber is defined by the center core 9, the separator core 13 and the inner wall of the casing 15; and a bottom hopper 8.

FIG. 7 is a cross-sectional view of FIG. 6, which is taken by line A-A.

As shown in FIG. 7, provision of the louver ring 6 in the dispersion chamber 1 allows the high-pressure air and the powder material (flowing powder) fed from the powder material feeding port 2 to pass through the flow path 3 to be distributed to the entire circumferential positions of the louver ring 6. In addition, the powder material passes through the gaps between the slats 5 of the louver ring 6 to flow into the inside 4 of the dispersion chamber. As a result, the powder fluid flows equally into the inside of the louver ring 6 (dispersion chamber inside 4) from the circumference of the louver ring 6, further improving dispersion of the powder material in the dispersion chamber 1.

Also, as shown in FIG. 7, the classifying apparatus of the present invention contains the louver ring 6 having a plurality of slats 5 annularly arranged in the dispersion chamber inside 4, wherein the relationship R1≥R2 is satisfied where R1 denotes a distance from the center 19 of the louver ring to an intersection point 18 which is formed by an extended line of a wall surface 2*b* of the powder material feeding port 2 at the side of the louver ring (i.e., an extended line of a straight line connecting the inner inlet 16 with the inner outlet 17 of the powder material feeding port) and by a line that is in parallel with a line containing the opening of the powder material feeding port and that passes through the center 19 of the louver ring 6; and R2 denotes a distance from the outer circumference of the louver ring 6 to the center 19 of the louver ring 6.

The center 19 of the louver ring 6 is defined by the central axis of the classifying apparatus in the gravity direction.

When the louver ring 6 is configured so as to satisfy the above relationships, the powder material fed from the powder material feeding port 2 passes through the gaps between the slats of the louver ring 6 to be dispersed into the inside of the dispersion chamber 1 from the entire circumferential positions, which advantageously prevents the fed particles from being aggregated.

Also, when the relationship R1≥R2 is satisfied, the louver ring 6 is disposed inside (i.e., at the side of the center 19 of the louver ring 6) of the extended line of the wall surface 2*b* of the powder material feeding port 2 at the side of the louver ring (i.e., an extended line of a straight line connecting the powder material feeding port's inner inlet 16 and the powder material feeding port's inner outlet 17). With this configuration, the air flow fed from the powder material feeding port 2 does not collide with the slats 5, not disturbing the air flow between the slats 5. In addition, the speed of air flow between the slats 5 annularly arranged becomes uniform on the circumference. Thus, the fed powder material can sufficiently be dispersed to attain efficient centrifugal separation into coarse particles and fine particles.

Figure 5:
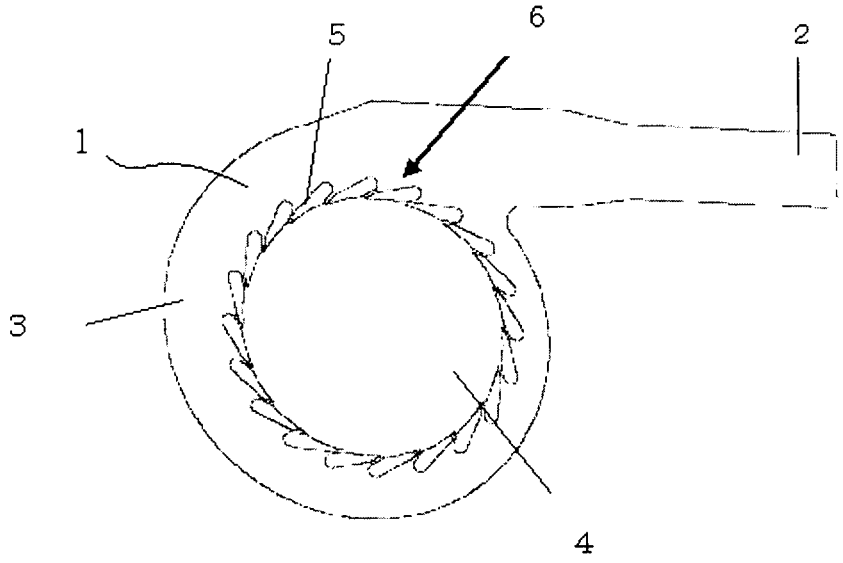
FIG. 5 is a cross-sectional view of a conventional classifying apparatus.

The present inventors conducted numerical analysis for comparison between the louver ring 6 having a plurality of slats 5 annularly arranged in which the relationship of R1≥R2 is satisfied and a conventional louver ring (R1<R2) illustrated in FIG. 5, where R1 denotes a distance from the center 19 of the louver ring 6 to an intersection point 18 which is formed by an extended line of a straight line connecting the powder material feeding port's inner inlet 16 with the powder material feeding port's inner outlet 17 and by a line that is in parallel with a line containing the feed opening 2*a* of the powder material feeding port 2 and that passes through the center 19 of the louver ring 6 (i.e., by a straight line that extends from the center 19 of the louver ring 6 in parallel with the feed opening 2*a* of the powder material feeding port 2) and R2 denotes a distance from the outer circumference of the louver ring 6 to the center 19 of the louver ring 6. As a result, they have found that when the speeds of air flow passing through the gaps between the slats 5 were extracted on the circumference, the difference between the maximum speed and the minimum speed was found to be about 18 m/s when using the conventional louver ring illustrated in FIG. 5 while to be about 4 m/s when using the louver ring 6 satisfying the relationship of R1≥R2.

According to the experiment and numerical analysis previously performed by the present inventors, it was found that, in a classification mechanism of separating powder material into coarse powder and fine powder using the louver ring 6 disposed in the dispersion chamber like the present invention, the classification efficiency was clearly improved when the difference between the maximum speed and the minimum speed was about 5 m/s or lower as a result of extraction of the speeds of the powder material passing through the gaps between the slats 5. Thus, by satisfying the relationship of R1≥R2 in which the difference between the maximum speed and the minimum speed of the speed of air flow passing through the gaps between the slats 5 is 5 m/s or lower, the classification efficiency can be improved more than conventional cases.

Next, in addition to the relationship R1≥R2, numerical analysis was conducted for comparing the louver ring 6 satisfying the relationship $\alpha \geq 30°$ and the louver ring 6 satisfying the relationship $\alpha < 30°$ with each other, where a denotes an angle between lines connecting the center of the louver ring 6 with both ends of each slat 5 of the louver ring 6. As a result, the difference between the maximum speed and the minimum speed was about 2 m/s as a result of extraction of the speeds of air flow passing through the gaps between the slats 5 when using the louver ring 6 satisfying the relationships $\alpha \geq 30°$ and R1≥R2. Thus, the difference of the maximum and minimum speeds could be decreased by about 2 m/s as compared with the difference therebetween when satisfying the relationship R1≥R2; i.e., about 4 m/s. Also, when using the louver ring 6 satisfying the relationships R1≥R2 and $\alpha < 30°$, the difference between the maximum speed and the minimum speed was about 5 m/s. This difference was greater by about 1 m/s than that obtained when satisfying the relationship R1≥R2, not showing advantageous effects. Thus, by satisfying the relationship $\alpha \geq 30°$, the classification efficiency can be improved more than conventional cases. Note that the upper limit of $\alpha$ is about 65°.

Furthermore, in addition to the relationship R1≥R2, numerical analysis was conducted for comparing the louver ring 6 satisfying the relationship $\beta \geq 15°$ and the louver ring 6 satisfying the relationship $\beta < 15°$ with each other, where $\beta$ denotes an angle formed between a line connecting the center 19 of the louver ring 6 with the powder material feeding port's inner outlet 17 and a line connecting the center 19 of the louver ring 6 with the intersection point 18 which is formed by an extended line of the wall surface 2*b* of the powder material feeding port 2 at the side of the louver ring (i.e., a straight line connecting the powder material feeding port's inner inlet 16 with the powder material feeding port's inner outlet 17) and by a line that is in parallel with a line containing an opening 2*a* of the powder material feeding port 2 and that passes through the center 19 of the louver ring 6 (i.e., by a straight line that extends from the center 19 of the louver ring 6 in parallel with the feed opening 2*a* of the powder material feeding port 2). As a result, when using the louver ring 6 satisfying the relationships $\beta \geq 15°$ and R1≥R2, the difference between the maximum speed and the minimum speed was about 3 m/s as a result of extraction of the speeds passing through the gaps between the slats 5 on the circumference. Thus, the difference of the maximum and minimum speeds could be decreased by about 1 m/s as compared with the difference therebetween when satisfying the relationship R1≥R2; i.e., 4 m/s. Also, when using the louver ring 6 satisfying the relationship R1≥R2 and the louver ring 6 satisfying the relationships R1≥R2 and $\beta < 15°$, the difference between the maximum speed and the minimum speed was about 5 m/s in either case. This difference was greater by about 1 m/s than that obtained when satisfying the relationship R1≥R2, not showing advantageous effects. Thus, by satisfying the relationship β≥15°, the classification efficiency can be improved more than conventional cases. Note that the upper limit of β is about 45°.

Further, as illustrated in FIGS. 8A to 8D, the slats 5 constituting the louver ring 6 are made detachably mountable. FIGS. 8A to 8D are structural drawings each showing part of a detachment mechanism of the slats in relation to a state in which the slats have been detached from a respective classifying apparatus. In general, when a classifying apparatus is continuously operated to classify powder material, the powder material may adhere to the surfaces of the slats 5, although the extent depends upon classifying conditions and the type of the powder material. When the adherence of the powder material proceeds, cleaning at the time when the powder material is changed will be troublesome. Moreover, the gaps between the slats 5 are narrowed owing to the adherence of the powder material, thereby causing pressure loss. As a result, the fed air does not smoothly flow, the speed of the airflow in the classification chamber 7 decreases, and thus there may be a decrease in classification efficiency. Thus, by making the slats 5 detachably mountable, it is possible to simplify the operation of cleaning off the attached powder material and thereby reduce the time spent on the cleaning, so that the total amount of time required at the time of a change in conditions is shortened and thus it is possible to improve productivity.

Regarding the classifying apparatus and the classifying method of the present invention, it is possible to increase the classification efficiency by making a simple alteration to the louver ring 6 that is a component of the classifying apparatus and thus to highly efficiently classify particles of a desired diameter range with less error and favorable classification accuracy. Furthermore, the classifying apparatus and the classifying method of the present invention can be highly effectively applied to production of products in fine powder form which are some micrometers in particle diameter, for example, resins, agricultural chemicals, cosmetics and pigments. In particular, they are suitable for the method for producing a toner described below.

(Method for Producing a Toner)

A method of the present invention for producing a toner includes at least a classifying step, preferably includes a melt-kneading step and a pulverizing step and, if necessary, includes other step(s).

The classifying step is performed using the above-described classifying apparatus of the present invention.

<Melt-Kneading Step>

The melt-kneading step is a step of mixing toner materials together and melt-kneading the resultant mixture in a melt-kneader.

The melt-kneader is not particularly limited and may be appropriately selected depending on the intended purpose. Examples thereof include uniaxial or biaxial continuous kneaders and batch kneaders using a roll mill. Specific examples thereof are not particularly limited and may be appropriately selected depending on the intended purpose, and include a KTK-type biaxial extruder (product of Kobe Steel, Ltd.), a TEM-type extruder (product of TOSHIBA MACHINE CO., LTD.), a KCK kneader (product of ASADA IRON WORKS, CO., LTD.), a PCM-type biaxial extruder (product of IKEGAI IRON WORKS, LTD.) and a co-kneader (product of BUSS AG). This melt-kneading is preferably performed under appropriate conditions so as not to bring about cleavage of molecular chains of the binder resin. Specifically, the temperature at which the melt-kneading takes place is decided considering the softening point of the binder resin. When the temperature is far higher than the softening point, cleavage of the molecular chains occurs to a considerable extent. When the temperature is far lower than the softening point, a sufficiently dispersed state is difficult to attain.

The toner materials include at least a binder resin, a colorant, a release agent and a charge controlling agent and, if necessary, include other component(s).

—Binder Resin—

The binder resin is not particularly limited and may be appropriately selected depending on the intended purpose. Examples thereof include homopolymers and copolymers exemplified by styrenes such as styrene and chlorostyrene; monoolefins such as ethylene, propylene, butylene and isoprene; vinylesters such as vinyl acetate, vinyl propionate, vinyl benzoate and vinyl butyrate; α-methylene aliphatic monocarboxylic acid esters—such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone.

Among them, typical examples thereof are not particularly limited and may be appropriately selected depending on the intended purpose, and include polystyrene resins, polyester resins, styrene-acrylic copolymers, styrene-alkyl acrylate copolymers, styrene-alkyl methacrylate copolymers, styrene-acrylonitrile copolymers, styrene-butadiene copolymers, styrene-maleic anhydride copolymers, polyethylene resins and polypropylene resins. These may be used individually or in combination.

—Colorant—

The colorant is not particularly limited and may be suitably selected from known dyes and pigments according to the purpose. Examples thereof include carbon black, nigrosine dyes, iron black, Naphthol Yellow S, Hansa Yellow (10G, 5G, G), cadmium yellow, yellow iron oxide, yellow ocher, yellow lead, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, isoindolinone yellow, red ocher, red lead, lead vermilion, cadmium red, cadmium mercury red, antimony vermilion, Permanent Red 4R, Para Red, Fire Red, p-chlor-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, oil red, quinacridone red, pyrazolone red, polyazo red, chrome vermilion, benzidine orange, perynone orange, oil orange, cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxane violet, anthraquinone violet, chrome green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone. These may be used individually or in combination.

The color of the colorant is not particularly limited and may be suitably selected according to the purpose. For example, a black colorant, a color colorant, etc. may be used. These may be used individually or in combination.

Examples of the black colorant include carbon blacks (C.I. Pigment Black 7) such as furnace black, lamp black, acetylene black and channel black; metals such as copper, iron (C.I. Pigment Black 11) and titanium oxide; and organic pigments such as aniline black (C.I. Pigment Black 1).

Examples of color pigments for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Vat Red 1, 2, 10, 13, 15, 23, 29 and 35.

Examples of color pigments for cyan include C.I. Pigment Blue 2, 3, 15, 15:1, 15:2, 15:3, 15:4, 15:6, 16, 17 and 60; C.I. Vat Blue 6; C.I. Acid Blue 45, copper phthalocyanine pigments each having as substituent(s) one to five phthalimidemethyl groups on the phthalocyanine skeleton, Green 7 and Green 36.

Examples of color pigments for yellow include C.I. Pigment Yellow 1, 2, 3, 4, 5, 6, 7, 10, 11, 12, 13, 14, 15, 16, 17, 23, 55, 65, 73, 74, 83, 97, 110, 151, 154 and 180; C.I. Vat Yellow 1, 3 and 20, and Orange 36.

The amount of the colorant contained in the toner is not particularly limited and may be suitably selected according to the purpose. The amount thereof is preferably 1% by mass to 15% by mass, more preferably 3% by mass to 10% by mass. When the amount is less than 1% by mass, the coloring capability of the toner decreases. When the amount is more than 15% by mass, the pigment is poorly dispersed in the toner, possibly leading to a decrease in coloring capability and degradation of electrical properties of the toner.

The colorant may be compounded with a resin to form a masterbatch. The resin is not particularly limited and may be suitably selected from resins known in the art, according to the purpose. Examples thereof include styrene polymers, polymers of substituted styrene, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosin, modified rosin, terpene resins, aliphatic hydrocarbon resins, alicyclic hydrocarbon resins, aromatic petroleum resins, chlorinated paraffins and paraffins. These may be used individually or in combination.

The styrene polymers and the polymers of substituted styrene are not particularly limited and may be appropriately selected depending on the intended purpose. Examples thereof include polyester resins, polystyrene resins, poly-p-chlorostyrene resins and polyvinyltoluene resins.

The styrene copolymers are not particularly limited and may be appropriately selected depending on the intended purpose. Examples thereof include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be produced by mixing or kneading the colorant and the resin for use in a masterbatch with the application of high shearing force. In doing so, an organic solvent is preferably added to enhance interaction between the colorant and the resin. Also, use of the so-called flashing method is suitable in that a wet cake of the colorant can be used as it is, without the need to dry it. The flashing method is a method in which an aqueous paste containing a colorant is mixed or kneaded with a resin and an organic solvent and then the colorant is transferred to the resin to remove water and components of the organic solvent. For this mixing or kneading, a high-shearing dispersing apparatus such as a triple roll mill is suitably used.

—Release Agent—

The release agent is not particularly limited and may be suitably selected from release agents known in the art, according to the purpose. Examples thereof include waxes such as carbonyl group-containing waxes, polyolefin waxes and long-chain hydrocarbons. These may be used individually or in combination.

The carbonyl group-containing waxes are not particularly limited and may be appropriately selected depending on the intended purpose. Examples thereof include polyalkanoic acid esters, polyalkanol esters, polyalkanoic acid amides, polyalkylamides and dialkyl ketones.

The polyalkanoic acid esters are not particularly limited and may be appropriately selected depending on the intended purpose. Examples thereof include carnauba wax, montan wax, trimethylolpropane tribehenate, pentaerythritol tetrabehenate, pentaerythritol diacetate dibehenate, glycerin tribehenate and 1,18-octadecanediol distearate.

The polyalkanol esters are not particularly limited and may be appropriately selected depending on the intended purpose. Examples thereof include tristearyl trimellitate and distearyl maleate.

The polyalkanoic acid amides are not particularly limited and may be appropriately selected depending on the intended purpose. Examples thereof include dibehenyl amide.

The polyalkylamides are not particularly limited and may be appropriately selected depending on the intended purpose. Examples thereof include trimellitic acid tristearyl amide.

The dialkyl ketones are not particularly limited and may be appropriately selected depending on the intended purpose. Examples thereof include distearyl ketone. Among these carbonyl group-containing waxes, polyalkanoic acid esters are preferred.

The polyolefin waxes are not particularly limited and may be appropriately selected depending on the intended purpose. Examples thereof include polyethylene wax and polypropylene wax.

The long-chain hydrocarbons are not particularly limited and may be appropriately selected depending on the intended purpose. Examples thereof include paraffin wax and Sasol Wax.

The amount of the release agent contained in the toner is not particularly limited and may be suitably selected according to the purpose. The amount is preferably 40% by mass or less, more preferably 3% by mass to 30% by mass. When the amount is greater than 40% by mass, the flowability of the toner may degrade.

—Charge Controlling Agent—

The charge controlling agent is not particularly limited and may be-suitably selected from charge controlling agents known in the art, according to the purpose. Nevertheless, the material for the charge controlling agent is preferably colorless or whitish, since use of a colored material may cause a change in color tone. Examples of such colorless or whitish materials include triphenylmethane-based dyes, molybdic acid chelate pigments, rhodamine-based dyes, alkoxy amines, quaternary ammonium salts (including fluorine-modified quaternary ammonium salts), alkylamides, phosphorus, phosphorus-containing compounds, tungsten, tungsten-containing compounds, fluorine-based activators, metal salts of salicylic acid and metal salts of salicylic acid derivatives. These may be used individually or in combination.

The charge controlling agent may be a commercially available product. Examples thereof include BONTRON P-51 (quaternary ammonium salt), E-82 (oxynaphthoic acid-based metal complex), E-84 (salicylic acid-based metal complex) and E-89 (phenolic condensate) (which are manufactured by ORIENT CHEMICAL INDUSTRIES CO., LTD.); TP-302 and TP-415 (quaternary ammonium salt molybdenum complexes) (which are manufactured by HODOGAYA CHEMICAL CO., LTD.); COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salts) (these products are of Hoechst); LRA-901 and LR-147 (boron complex) (which are manufactured by Japan Carlit Co., Ltd.); quinacridone, and azo-based pigments; and polymeric compounds containing a sulfonic acid group, a carboxyl group, a quaternary ammonium salt, etc.

The charge controlling agent may be dissolved or dispersed in the toner after melt-kneaded with the masterbatch, may be directly added to the organic solvent together with the components of the toner when dissolved or dispersed, or may be fixed on the surface of toner particles after the formation of the toner particles.

The amount of the charge controlling agent contained in the toner depends upon the type of the binder resin, the presence or absence of additive(s) and the dispersing process employed and therefore cannot be unequivocally defined. However, the amount is preferably 0.1 parts by mass to 10 parts by mass, more preferably 0.2 parts by mass to 5 parts by mass, per 100 parts by mass of the binder resin.

When the amount is less than 0.1 parts by mass, favorable charge controlling properties may not be obtained. When the amount is greater than 10 parts by mass, the chargeability of the toner is so large that the effects of a main charge controlling agent are reduced, and the electrostatic attraction force between the toner and a developing roller increases, which possibly lease to a degradation of the flowability of a developer and/or image density.

—Other Component(s)—

The above-mentioned other component(s) is/are not particularly limited and may be suitably selected according to the purpose. Examples thereof include an external additive, a flowability improver, a cleanability improver, a magnetic material and metal soap.

The external additive is not particularly limited and may be suitably selected from external additives known in the art, according to the purpose. Examples thereof include fine silica particles, hydrophobized fine silica particles, fatty acid metal salts (e.g. zinc stearate and aluminum stearate); metal oxides (e.g. titania, alumina, tin oxide and antimony oxide) and hydrophobized products thereof, and fluoropolymers. Among these, hydrophobized fine silica particles, titania particles and hydrophobized fine titania particles are preferred.

<Pulverizing Step>

The pulverizing step is a step of performing fine pulverization using at least one pulverizer and, in some cases, employing at least one coarse powder classifying step. The pulverizer used in the pulverizing step is not particularly limited and may be suitably selected according to the purpose. Examples thereof include airflow pulverizers, fluidized-bed pulverizers and mechanical pulverizers.

Examples of the airflow pulverizers include ULTRASONIC JET PULVERIZER manufactured by Nippon Pneumatic Mfg. Co., Ltd., SUPER JET MILL manufactured by NISSHIN ENGINEERING INC. and MICRON JET manufactured by Hosokawa Micron Corporation.

Examples of the fluidized-bed pulverizers include COUNTER JET PULVERIZER manufactured by Hosokawa Micron Corporation and CROSS JET MILL manufactured by Kurimoto, Ltd.

Examples of the mechanical pulverizers include KRYPTRON manufactured by EARTH TECHNICA CO. LTD. SUPER ROTOR manufactured by NISSHIN ENGINEERING INC. and TURBO MILL manufactured by TURBO KOGYO CO., LTD.

(Toner)

A toner of the present invention is produced by the method of the present invention for producing a toner. The toner preferably contains fine powder having a particle diameter of 4.0 μm or smaller in an amount of 15% by number or less, more preferably 10% by number or less. Also, the toner preferably contains coarse powder having a particle diameter of 12.7 μm or larger in an amount of 5.0% by mass or less, more preferably 0% by mass to 2.0% by mass.

Further, the volume average particle diameter of the toner is preferably 5.0 μm to 12.0 μm, more preferably 5.0 μm to 8.0 μm.

Here, the particle size distribution and the volume average particle diameter can, for example, be measured using a particle size measuring apparatus (COULTER COUNTER TA-II, COULTER MULTISIZER II or COULTER MULTISIZER III, manufactured by Beckman Coulter, Inc.).

EXAMPLES

The present invention will next be described by way of Examples, which should not be construed as limiting the present invention thereto.

In the following Examples, a mixture of 85 parts by mass of a styrene-acrylic copolymer and 15 parts by mass of carbon black was melt-kneaded and cooled. Subsequently, the mixture was coarsely pulverized using a hammermill to prepare powder material, and the powder material was finely pulverized using a fluidized-bed pulverizer and then classified using the classifying apparatus shown in FIGS. 6 and 7.

In the following Examples and Comparative Examples, the particle size distribution and volume average particle diameter of particles were measured as follows.

<Measurement of Volume Average Particle Diameter and Particle Size Distribution>

As an apparatus for measuring the volume average particle diameter and the particle size distribution according to the Coulter Counter method, COULTER MULTISIZER III (product of Beckman Coulter, Inc.) was used to measure the particle diameter and the particle size distribution.

First, 0.1 mL to 5 mL of a surfactant (alkylbenzene sulfonate) was added as a dispersant into 100 mL to 150 mL of an electrolytic solution. Here, the electrolytic solution was a 1% by mass NaCl aqueous solution prepared using primary sodium chloride; for example, ISOTON-II (produced by Coulter Corporation) may be used. Second, 2 mg to 20 mg of a measurement sample was added. The electrolytic solution in which the sample was suspended was subjected to dispersion treatment for one minute to three minutes using an ultrasonic dispersion apparatus. The volume of the powder was measured by the apparatuses, using an aperture of 100 μm, and the volume distribution was calculated. Based upon the volume distribution obtained, the volume average particle diameter and the particle size distribution of the powder were calculated.

As channels, the following 13 channels were used, and particles having diameters which are equal to or greater than 2.00 μm but less than 40.30 μm were targeted: a channel of 2.00 μm or greater but less than 2.52 μm; a channel of 2.52 μm or greater but less than 3.17 μm; a channel of 3.17 μm or greater but less than 4.00 μm; a channel of 4.00 μm or greater but less than 5.04 μm; a channel of 5.04 μm or greater but less than 6.35 μm; a channel of 6.35 μm or greater but less than 8.00 μm; a channel of 8.00 μm or greater but less than 10.08 μm; a channel of 10.08 μm or greater but less than 12.70 μm; a channel of 12.70 μm or greater but less than 16.00 μm; a channel of 16.00 μm or greater but less than 20.20 μm; a channel of 20.20 μm or greater but less than 25.40 μm; a channel of 25.40 μm or greater but less than 32.00 μm; and a channel of 32.00 μm or greater but less than 40.30 μm.

Example 1

A powder material was classified with a classifying apparatus shown in FIG. 7 using a louver ring 6 set so as to satisfy the following: Distance R1=275 mm, Distance R2=260 mm, Angle α=25° and Angle β=10°. In this louver ring, the thickness of each slat 5 was 4 mm and the number of slats 5 was 13. The obtained powder material was found to have a volume average particle diameter of 4.7 μm (measured according to the Coulter Counter method) and to contain coarse particles having a particle diameter of 8.0 μm or more in an amount of 1.6% by mass. The amount of the powder material processed per hour; i.e., feed amount, was found to be 80 kg/h.

Example 2

A powder material was classified under the same conditions and with the same apparatus as in Example 1, except that the louver ring was changed to a louver ring 6 set so as to satisfy the following: R1=275 mm, R2=260 mm, α=30° and β=10°. The obtained powder material was found to have a volume average particle diameter of 4.7 μm (measured according to the Coulter Counter method) and to contain coarse particles having a particle diameter of 8.0 μm or more in an amount of 1.5% by mass. The amount of the powder material processed per hour; i.e., feed amount, was found to be 82 kg/h.

Example 3

A powder material was classified under the same conditions and with the same apparatus as in Example 1, except that the louver ring was changed to a louver ring 6 set so as to satisfy the following: R1=275 mm, R2=260 mm, α=25° and β=15°. The obtained powder material was found to have a volume average particle diameter of 4.7 μm (measured according to the Coulter Counter method) and to contain coarse particles having a particle diameter of 8.0 μm or more in an amount of 1.6% by mass. The amount of the powder material processed per hour; i.e., feed amount, was found to be 83 kg/h.

Example 4

A powder material was classified under the same conditions and with the same apparatus as in Example 1, except that the louver ring was changed to a louver ring 6 set so as to satisfy the following: R1=275 mm, R2=260 mm, α=30° and β=15°. The obtained powder material was found to have a volume average particle diameter of 4.7 μm (measured according to the Coulter Counter method) and to contain coarse particles having a particle diameter of 8.0 μm or more in an amount of 1.6% by mass. The amount of the powder material processed per hour; i.e., feed amount, was found to be 85 kg/h.

Example 5

A powder material was classified under the same conditions and with the same apparatus as in Example 1, except that the louver ring was changed to a louver ring 6 set so as to satisfy the following: R1=275 mm, R2=260 mm, α=40° and β=15°. The obtained powder material was found to have a volume average particle diameter of 4.7 μm (measured according to the Coulter Counter method) and to contain coarse particles having a particle diameter of 8.0 μm or more in an amount of 1.4% by mass. The amount of the powder material processed per hour; i.e., feed amount, was found to be 87 kg/h.

Example 6

A powder material was classified under the same conditions and with the same apparatus as in Example 1, except that the louver ring was changed to a louver ring 6 set so as to satisfy the following: R1=275 mm, R2=260 mm, α=40° and β=30°. The obtained powder material was found to have a volume average particle diameter of 4.7 μm (measured according to the Coulter Counter method) and to contain coarse particles having a particle diameter of 8.0 μm or more in an amount of 1.6% by mass. The amount of the powder material processed per hour; i.e., feed amount, was found to be 90 kg/h.

Example 7

A powder material was classified under the same conditions and with the same apparatus as in Example 1, except that the louver ring was changed to a louver ring 6 set so as to satisfy the following: R1=275 mm, R2=275 mm, α=25° and β=10°. The obtained powder material was found to have a volume average particle diameter of 4.7 μm (measured according to the Coulter Counter method) and to contain coarse particles having a particle diameter of 8.0 μm or more in an amount of 1.6% by mass. The amount of the powder material processed per hour; i.e., feed amount, was found to be 78 kg/h.

Example 8

A powder material was continuously classified in the same manner as in Example 1 except that the slats were changed to detachable slats 5. After the louver ring 6 had been cleaned, continuous classification was performed again on a different type of powder material. As a result, the cleaning time for the louver ring 6 could be shortened about 50% of that in Example 1.

Comparative Example 1

A powder material was classified under the same conditions and with the same apparatus as in Example 1, except that the louver ring was changed to a louver ring 6 set so as to satisfy the following: R1=220 mm, R2=260 mm, α=20° and β=30° and that the number of slats 5 was changed to 24. The obtained powder material was found to have a volume average particle diameter of 4.7 μm (measured according to the Coulter Counter method) and to contain coarse particles having a particle diameter of 8.0 μM or more in an amount of 1.6% by mass. The amount of the powder material processed per hour; i.e., feed amount, was found to be 75 kg/h.

Comparative Example 2

A powder material was classified under the same conditions and with the same apparatus as in Comparative Example 1, except that the louver ring was changed to a louver ring 6 set so as to satisfy the following: R1=220 mm, R2=260 mm, α=15° and β=30° and that the number of slats 5 was changed to 24. The obtained powder material was found to have a volume average particle diameter of 4.7 μm (measured according to the Coulter Counter method) and to contain coarse particles having a particle diameter of 8.0 μm or more in an amount of 1.8% by mass. The amount of the powder material processed per hour; i.e., feed amount, was found to be 73 kg/h.

TABLE 1

| | R1 (mm) | R2 (mm) | α (°) | β (°) | Volume average particle diameter (μm) | Amount of coarse particles having a particle diameter of 8.0 μm or more (% by mass) | Feed amount (kg/h) |
|---|---|---|---|---|---|---|---|
| Ex. 1 | 275 | 260 | 25 | 10 | 4.7 | 1.6 | 80 |
| Ex. 2 | 275 | 260 | 30 | 10 | 4.7 | 1.5 | 82 |
| Ex. 3 | 275 | 260 | 25 | 15 | 4.7 | 1.6 | 83 |
| Ex. 4 | 275 | 260 | 30 | 15 | 4.7 | 1.6 | 85 |
| Ex. 5 | 275 | 260 | 40 | 15 | 4.7 | 1.4 | 87 |
| Ex. 6 | 275 | 260 | 40 | 30 | 4.7 | 1.6 | 90 |
| Ex. 7 | 275 | 275 | 25 | 10 | 4.7 | 1.6 | 78 |
| Comp. Ex. 1 | 220 | 260 | 20 | 30 | 4.7 | 1.6 | 75 |
| Comp. Ex. 2 | 220 | 260 | 15 | 30 | 4.7 | 1.8 | 73 |

The classifying apparatus and the classifying method of the present invention can stabilize the classification efficiency by making a simple alteration to the louver ring of the classifying apparatus and can highly efficiently classify particles of a desired diameter range with less error and favorable classification accuracy for a long period of time. Thus, they can be applied to production of products in fine powder form which are some micrometers in particle diameter, for example, resins, agricultural chemicals, cosmetics and pigments. In particular, they are suitable for the method for producing a dry toner for developing electrostatic images, especially in electrophotography, electrostatic recording, electrostatic printing, etc.

This application claims priority to Japanese patent application No. 2010-189348, filed on Aug. 26, 2010, and incorporated herein by reference.

What is claimed is:

1. A classifying apparatus comprising:

a cylindrical casing, a powder material feeding port for feeding high-pressure air and powder material to the cylindrical casing, a louver ring disposed in the casing so as to be in communication with the powder material feeding port in a horizontal direction, the louver ring having a plurality of arc-shaped guide slats annularly arranged, wherein the classifying apparatus satisfies a relationship of α≥30° where, in the horizontal cross section, a denotes an angle formed between lines connecting the center of the louver ring with both ends of each of the guide slats, a center core disposed at the powder material-discharged side of the powder material feeding port, a separator core disposed at the powder material-discharged side of the center core, the separator core having an opening at a center thereof, a dispersion chamber defined by the center core and an inner wall of the casing at the powder material-fed side, the dispersion chamber being for dispersing the powder material together with the high-pressure air, wherein the louver ring is disposed in the dispersion chamber, a classification chamber defined by the center core, the separator core and a side inner wall of the casing, the classification chamber being for centrifugally separating the powder material fed from the dispersion chamber into fine powder and coarse powder, and a flow path encircling the louver ring, the flow path receiving the high-pressure air and the powder material fed from the powder material feeding port, wherein in a horizontal cross section of part of the classifying apparatus where the part contains the powder material feeding port and the louver ring, the louver ring is located at a position where the louver ring does not intersect with an extended line of a wall surface of the powder material feeding port at the side of the louver ring.

2. The classifying apparatus according to claim 1, wherein the classifying apparatus satisfies a relationship of R1≥R2 where, in the horizontal cross section, R1 denotes a distance from the center of the louver ring to an intersection point which is formed by the extended line of the wall surface of the powder material feeding port at the side of the louver ring and by a line that extends from the center of the louver ring in parallel with a line containing a feed opening of the powder material feeding port; and R2 denotes a distance from an outer circumference of the louver ring to the center of the louver ring.

3. The classifying apparatus according to claim 1, wherein the classifying apparatus satisfies a relationship of β≥15° where, in the horizontal cross section, β denotes an angle formed between two lines one of which connects the center of the louver ring with an intersection point formed by the extended line of the wall surface of the powder material feeding port at the side of the louver ring and by a line that extends from the center of the louver ring in parallel with a line containing a feed opening of the powder material feeding port, and the other of which connects the center of the louver ring with an intersection point formed by the side inner wall of the casing and the wall surface of the powder material feeding port at the side of the louver ring.

4. The classifying apparatus according to claim 1, wherein the guide slats are arranged at regular intervals concentrically around a central axis of the classifying apparatus in the gravity direction.

5. The classifying apparatus according to claim 1, wherein the guide slats are detachably mounted.

6. The classifying apparatus according to claim 1, wherein α is 40° to 60°.

7. The classifying apparatus according to claim 1, wherein a number of the guide slats is 10 to 20.

8. A classifying method comprising:

performing classification with a classifying apparatus, wherein the classifying apparatus comprises:

a cylindrical casing, a powder material feeding port for feeding high-pressure air and powder material to the cylindrical casing, a louver ring disposed in the casing so as to be in communication with the powder material feeding port in a horizontal direction, the louver ring having a plurality of arc-shaped guide slats annularly arranged, wherein the classifying apparatus satisfies a relationship of $\alpha \geq 30°$ where, in the horizontal cross section, a denotes an angle formed between lines connecting the center of the louver ring with both ends of each of the guide slats, a center core disposed at the powder material-discharged side of the powder material feeding port, a separator core disposed at the powder material-discharged side of the center core, the separator core having an opening at a center thereof, a dispersion chamber defined by the center core and an inner wall of the casing at the powder material-fed side, the dispersion chamber being for dispersing the powder material together with the high-pressure air, wherein the louver ring is disposed in the dispersion chamber, a classification chamber defined by the center core, the separator core and a side inner wall of the casing, the classification chamber being for centrifugally separating the powder material fed from the dispersion chamber into fine powder and coarse powder, and a flow path encircling the louver ring, the flow path receiving the high-pressure air and the powder material fed from the powder material feeding port, wherein in a horizontal cross section of part of the classifying apparatus where the part contains the powder material feeding port and the louver ring, the louver ring is located at a position where the louver ring does not intersect with an extended line of a wall surface of the powder material feeding port at the side of the louver ring.

9. The classifying method according to claim 8, wherein $\alpha$ is 40° to 60°.

10. The classifying method according to claim 8, wherein a number of the guide slats is 10 to 20.

11. A method for producing a toner, comprising:

classifying powder material with a classifying apparatus, wherein the classifying apparatus comprises:

a cylindrical casing, a powder material feeding port for feeding high-pressure air and powder material to the cylindrical casing, a louver ring disposed in the casing so as to be in communication with the powder material feeding port in a horizontal direction, the louver ring having a plurality of arc-shaped guide slats annularly arranged, wherein the classifying apparatus satisfies a relationship of $\alpha \geq 30°$ where, in the horizontal cross section, a denotes an angle formed between lines connecting the center of the louver ring with both ends of each of the guide slats, a center core disposed at the powder material-discharged side of the powder material feeding port, a separator core disposed at the powder material-discharged side of the center core, the separator core having an opening at a center thereof, a dispersion chamber defined by the center core and an inner wall of the casing at the powder material-fed side, the dispersion chamber being for dispersing the powder material together with the high-pressure air, wherein the louver ring is disposed in the dispersion chamber, a classification chamber defined by the center core, the separator core and a side inner wall of the casing, the classification chamber being for centrifugally separating the powder material fed from the dispersion chamber into fine powder and coarse powder, and a flow path encircling the louver ring, the flow path receiving the high-pressure air and the powder material fed from the powder material feeding port, wherein in a horizontal cross section of part of the classifying apparatus where the part contains the powder material feeding port and the louver ring, the louver ring is located at a position where the louver ring does not intersect with an extended line of a wall surface of the powder material feeding port at the side of the louver ring.

12. The method according to claim 11, wherein $\alpha$ is 40° to 60°.

13. The classifying method according to claim 11, wherein a number of the guide slats is 10 to 20.

* * * * *